US011189402B2

(12) United States Patent
Nakayama

(10) Patent No.: US 11,189,402 B2
(45) Date of Patent: Nov. 30, 2021

(54) METAL PLATE RESISTOR AND MANUFACTURING METHOD THEREOF

(71) Applicant: PANASONIC INTELLECTUAL PROPERTY MANAGEMENT CO., LTD., Osaka (JP)

(72) Inventor: Shogo Nakayama, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 361 days.

(21) Appl. No.: 16/335,600

(22) PCT Filed: Nov. 16, 2018

(86) PCT No.: PCT/JP2018/042474

§ 371 (c)(1),
(2) Date: Mar. 21, 2019

(87) PCT Pub. No.: WO2019/107188

PCT Pub. Date: Jun. 6, 2019

(65) Prior Publication Data

US 2021/0217544 A1 Jul. 15, 2021

(30) Foreign Application Priority Data

Dec. 1, 2017 (JP) ..... JP2017-231348

(51) Int. Cl.
*H01C 1/142* (2006.01)
*H01C 17/28* (2006.01)

(52) U.S. Cl.
CPC ..... *H01C 1/142* (2013.01); *H01C 17/28* (2013.01)

(58) Field of Classification Search
CPC ..... H01C 1/142; H01C 17/28
See application file for complete search history.

(56) References Cited

U.S. PATENT DOCUMENTS 6,801,118 B1 * 10/2004 Ikemoto ..... H01C 3/00 338/307
8,242,878 B2 * 8/2012 Smith ..... H01C 17/288 338/254
9,959,957 B2 * 5/2018 Tsuda ..... H01C 17/003
(Continued)

FOREIGN PATENT DOCUMENTS

JP 2004-022920 A 1/2004
JP 2004-186248 A 7/2004
(Continued)

OTHER PUBLICATIONS

International Search Report and Written Opinion issued in International Application No. PCT/JP2018/042474, dated Jan. 29, 2019.

*Primary Examiner* — Kyung S Lee
(74) *Attorney, Agent, or Firm* — McDermott Will and Emery LLP

(57) ABSTRACT

In a metal plate resistor according to the present disclosure, each of a pair of electrodes includes a first portion and a second portion. The first portion protrudes from one surface of a resistive element to be in contact with an end of a protection film. The second portion is disposed in a corresponding recess of a pair of recesses. In a direction in which the pair of electrodes is arranged, the second portion has a length longer than a length of the first portion.

5 Claims, 6 Drawing Sheets

(56) References Cited

U.S. PATENT DOCUMENTS

| | | | | |
|---|---|---|---|---|
| 2004/0252009 | A1* | 12/2004 | Tsukada | H01C 17/006 338/309 |
| 2005/0035844 | A1* | 2/2005 | Tsukada | H01C 17/281 338/309 |
| 2005/0225424 | A1 | 10/2005 | Tsukada | |
| 2005/0258930 | A1* | 11/2005 | Ishida | H01C 1/144 338/309 |
| 2006/0097340 | A1 | 5/2006 | Tsukda et al. | |
| 2006/0273423 | A1 | 12/2006 | Tsukada | |

FOREIGN PATENT DOCUMENTS

| | | | |
|---|---|---|---|
| JP | 2004-311747 | A | 11/2004 |
| JP | 2016-051841 | A | 4/2016 |

* cited by examiner

METAL PLATE RESISTOR AND MANUFACTURING METHOD THEREOF

CROSS-REFERENCE OF RELATED APPLICATIONS

This application is the U.S. National Phase under 35 U.S.C. § 371 of International Patent Application No. PCT/JP2018/042474, filed on Nov. 16, 2018, which in turn claims the benefit of Japanese Application No. 2017-231348, filed on Dec. 1, 2017, the entire disclosures of which Applications are incorporated by reference herein.

TECHNICAL FIELD

The present disclosure relates to a metal plate resistor used to detect a current amount by measuring a voltage across a pair of electrodes in an information communication device represented by a smartphone and a tablet computer. The present disclosure also relates to a manufacturing method of the metal plate resistor.

BACKGROUND ART

Patent Literature 1 describes a chip resistor including a resistive element and a plurality of electrodes. The resistive element is chip-shaped. The plurality of electrodes are provided on a front surface or a back surface of the resistive element with a space between the plurality of electrodes. The resistive element is made of, for example, a Ni—Cu-based alloy, a Cu—Mn-based alloy, or a Ni—Cr-based alloy. The plurality of electrodes are formed by, for example, plating the resistive element with copper.

In the chip resistor described in Patent Literature 1, a current flows through only the plurality of electrodes and a portion of the front surface or the back surface of the resistive element, the portion being located between the plurality of electrodes, and it is thus not possible to reduce a resistance value. Moreover, due to a large ratio of a resistor temperature coefficient (TCR) of the plurality of electrodes that contributes to a TCR of the entirety of the chip resistor, the TCR increases as the resistance value decreases. Here, the TCR of copper of which the plurality of electrodes are made is $4300\times10^{6}$/° C., which is a relatively large value.

CITATION LIST

Patent Literature

Patent Literature 1: JP 2004-311747 A

SUMMARY OF INVENTION

An object of the present disclosure is to provide a metal plate resistor which enables a resistance value and a TCR to be reduced, and a manufacturing method of the metal plate resistor.

A metal plate resistor of one aspect includes a resistive element, a pair of recesses, a pair of electrodes, and a protection film. The resistive element is made of metal. The pair of recesses is formed at opposing ends of one surface of the resistive element. The pair of electrodes has at least portions each embedded in a corresponding one of the pair of recesses. The pair of electrodes is made of metal having a lower specific resistance than the resistive element. The protection film is disposed on the one surface of the resistive element to be located between the pair of electrodes. Each of the pair of electrodes includes a first portion and a second portion. The first portion protrudes from the one surface of the resistive element to be in contact with an end of the protection film. The second portion is disposed in a corresponding recess of the pair of recesses. In a direction in which the pair of electrodes is arranged, the second portion has a length longer than a length of the first portion.

A manufacturing method of another aspect is a manufacturing method of a metal plate resistor and includes: a step of forming a plurality of grooves at regular intervals in a sheet-like resistive element made of metal, each of the plurality of grooves having a band-like shape; a step of filling the plurality of grooves with a resin to form resin layers each having a band-like shape; a step of forming a protection film on the sheet-like resistive element, the protection film having an opening formed such that the sheet-like resistive element is exposed at sites where the resin layers are not formed so as to have exposed portions; a step of forming a plurality of recesses by etching the exposed portions of the sheet-like resistive element, but not through the sheet-like resistive element; a step of performing plating in the plurality of recesses to form a plurality of electrode layers; and a step of performing cutting along a centerline of each of the resin layers each having a band-like shape and performing cutting along a line extending through centers of the plurality of electrode layers to divide the sheet-like resistive element into individual pieces, the line being transverse to the centerline.

DESCRIPTION OF EMBODIMENTS

First Configuration Example

Figure 1:
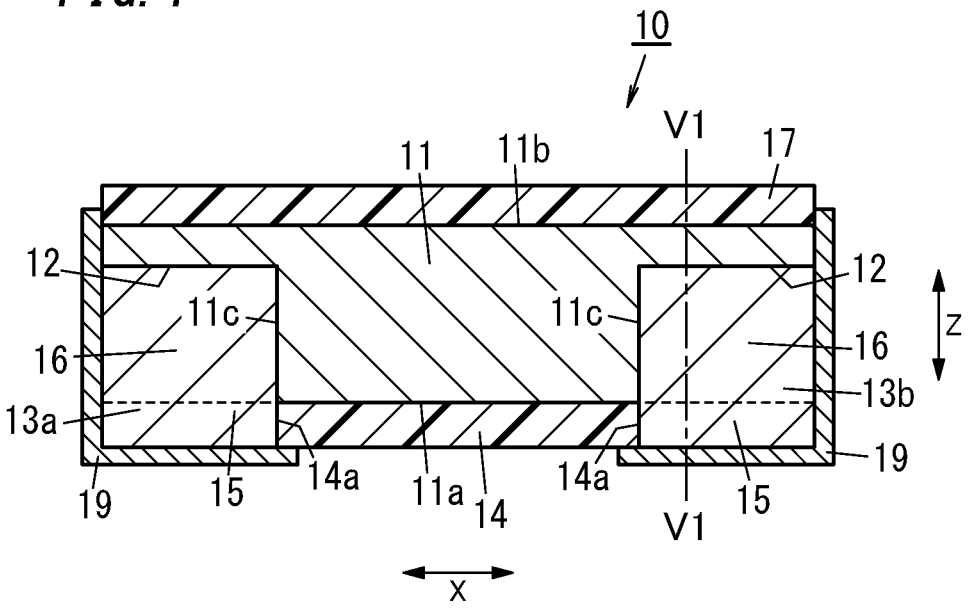
FIG. 1 is a sectional view illustrating a metal plate resistor of one embodiment of the present disclosure.
Figure 2:
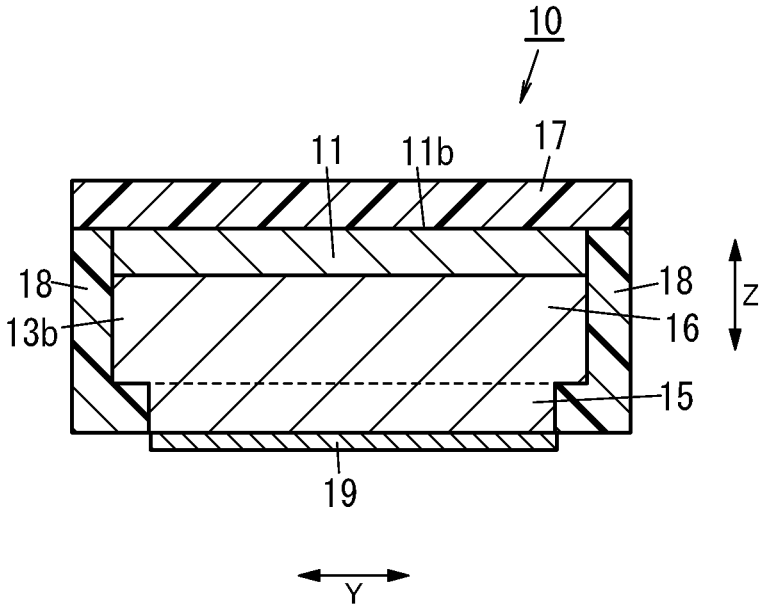
FIG. 2 is a sectional view taken along line V1-V1 of FIG. 1.

FIG. 1 is a sectional view illustrating a metal plate resistor 10 of one embodiment of the present disclosure. FIG. 2 is a sectional view taken along line V1-V1 of FIG. 1.

As illustrated in FIGS. 1 and 2, the metal plate resistor 10 of the one embodiment includes a resistive element 11, recesses 12, a pair of electrodes 13*a* and 13*b*, and a first protection film 14. The resistive element 11 includes a metal plate. The recesses 12 are each disposed at a corresponding one of both ends in a length direction (X direction) of a lower surface 11*a* of the resistive element 11. The pair of electrodes 13*a* and 13*b* is embedded in the recesses 12. The pair of electrodes 13*a* and 13*b* is made of metal having a lower specific resistance than the resistive element 11. The first protection film 14 is disposed on the lower surface 11*a* of the resistive element 11 to be located between the pair of electrodes 13*a* and 13*b*.

Each of the pair of electrodes 13*a* and 13*b* includes a first portion 15 and a second portion 16. The first portions 15 are in contact with both ends 14*a* of the first protection film 14. The both ends 14*a* are apart from each other in the X direction. The second portions 16 are disposed in the recesses 12 and are in contact with both end surfaces 11*c* of the resistive element 11. The both end surfaces 11*c* are apart from each other in the X direction. Each second portion 16 has a width larger than a width of each first portion 15.

In this configuration, the resistive element 11 is made of metal having a relatively high electric resistivity and a relatively low TCR. Examples of such metal include nichrome, copper nickel, and Manganin.

The resistive element 11 has the lower surface (one surface) 11*a* and an upper surface (another surface facing the one surface) 11*b* which are apart from each other in a thickness direction Z. Note that when a resistance value is adjusted, a slit (not shown) which does not penetrate through the resistive element 11 is formed in the lower surface 11*a* of the resistive element 11.

Moreover, each of the recesses 12 is formed at a corresponding one the both ends of the lower surface 11*a* of the resistive element 11. The both ends of the lower surface 11*a* are apart from each other in the length direction X. The recesses 12, however, do not extend to the upper surface 11*b* of the resistive element 11.

Moreover, the pair of electrodes 13*a* and 13*b* is made of metal such as copper or silver having a lower electric resistivity (specific resistance) and a higher TCR than the resistive element 11. The pair of electrodes 13*a* and 13*b* includes a thick-film material or plating. The pair of electrodes 13*a* and 13*b* is embedded in the recesses 12.

Moreover, the first protection film 14 is disposed on the lower surface 11*a* of the resistive element 11 to be located between the pair of electrodes 13*a* and 13*b* so as to cover an exposed portion of the resistive element 11. The first protection film 14 includes a thick-film material made of, for example, an epoxy resin.

Moreover, in the thickness direction Z (Z direction), the pair of electrodes 13*a* and 13*b* protrudes beyond the lower surface 11*a* of the resistive element 11, and portions (the first portions 15) of the pair of electrodes 13*a* and 13*b* are in contact with the both ends 14*a* of the first protection film 14.

That is, the pair of electrodes 13*a* and 13*b* is not only provided in the recesses 12 but also continuously and integrally extends to a portion where the first protection film 14 is formed. The pair of electrodes 13*a* and 13*b* is provided to be in contact with the both ends 14*a* of the first protection film 14.

The pair of electrodes 13*a* and 13*b* is dividable into the first portions 15 and the second portions 16. The first portions 15 are in contact with the both ends 14*a* of the first protection film 14. The second portions 16 are disposed in the recesses 12 and are in contact with the both end surfaces 11*c* of the resistive element 11. In this example, the both end surfaces 11*c* of the resistive element 11 are not exposed at sites apart from each other in the X direction of the resistive element 11 from the pair of electrodes 13*a* and 13*b*.

A lower surface of the first protection film 14 on the lower surface 11*a* of the resistive element 11 is flush with lower surfaces of the pair of electrodes 13*a* and 13*b*.

FIG. 2 is a sectional view taken along line V1-V1 of FIG. 1 in the thickness direction Z. The broken line in FIG. 2 represents an interface between the first protection film 14 (not shown in FIG. 2) and the lower surface 11*a* of the resistive element 11. Portions of the pair of electrodes 13*a* and 13*b* below the broken line correspond to the first portions 15, and portions of the pair of electrodes 13*a* and 13*b* above the broken line correspond to the second portions 16.

As illustrated in FIG. 2, in a width direction Y, the width of each of the second portions 16 of the pair of electrodes 13*a* and 13*b* is larger than the width of each of the first portions 15. In this example, the width direction Y is a direction orthogonal to the length direction X and the thickness direction Z. In other words, the direction (Y direction) transverse to a direction in which the pair of electrodes 13*a* and 13*b* is arranged is a direction transverse (orthogonal) to both the direction (X direction) in which the pair of electrodes 13*a* and 13*b* is arranged and the direction (Z direction) in which each first portion 15 and each second portion 16 are arranged.

Note that the pair of electrodes 13*a* and 13*b* does not have an L-shape formed by extending only the first portions 15 in the length direction X. This is to prevent that a current flows only in a vicinity of the lower surface 11*a* of the resistive element 11, the vicinity being located between the pair of electrodes 13*a* and 13*b*.

Moreover, in the width direction Y, the recesses 12 do not have to be formed in the entire surface of the resistive element 11.

The upper surface 11*b* of the resistive element 11 is covered with a second protection film 17 made of an epoxy resin. Moreover, the resistive element 11 and the pair of electrodes 13*a* and 13*b* have side surfaces apart from each other in the Y direction, and the side surfaces are also covered with a third protection film 18.

Moreover, a plating layer 19 is integrally formed on a surface of the resistive element 11 exposed from the pair of electrodes 13*a* and 13*b* and the lower surfaces and end surfaces of the pair of electrodes 13*a* and 13*b*. The plating layer 19 is made of nickel plating or tin plating.

A manufacturing method of the metal plate resistor 10 in the one embodiment of the present disclosure will be described below with reference to the drawings.

Note that for the sake of easy production, description is given with the metal plate resistor 10 illustrated in FIGS. 1 and 2 positioned upside down.

Figure 3A:
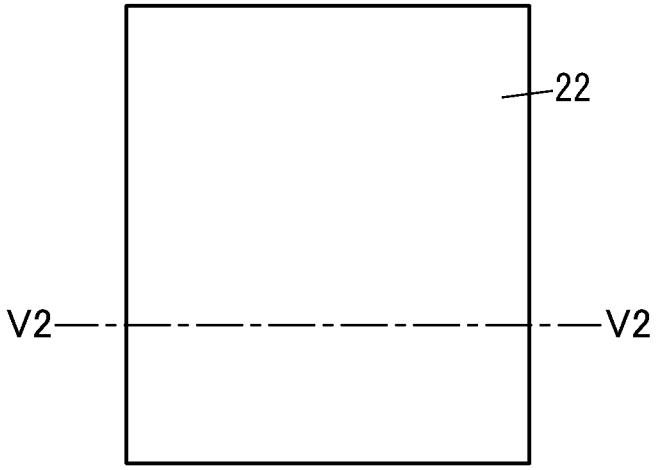
FIGS. 3A to FIG. 3D are views illustrating a manufacturing method of the metal plate resistor.
Figure 3B:
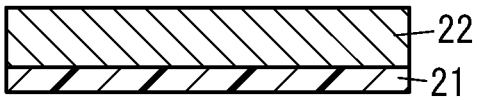

First, as illustrated in FIGS. 3A and 3B, a sheet-like resin substrate 21 having an upper surface provided with a sheet-like resistive element 22 made of metal such as CuMnNi is prepared. The sheet-like resin substrate 21 corresponds to the second protection film 17 of the metal plate resistor 10. Note that for transportation between steps, another sheet may be formed on a lower surface of the sheet-like resin substrate 21.

Here, FIG. 3A is a top view, and FIG. 3B is a sectional view taken along line V2-V2 of FIG. 3A.

Figure 3C:
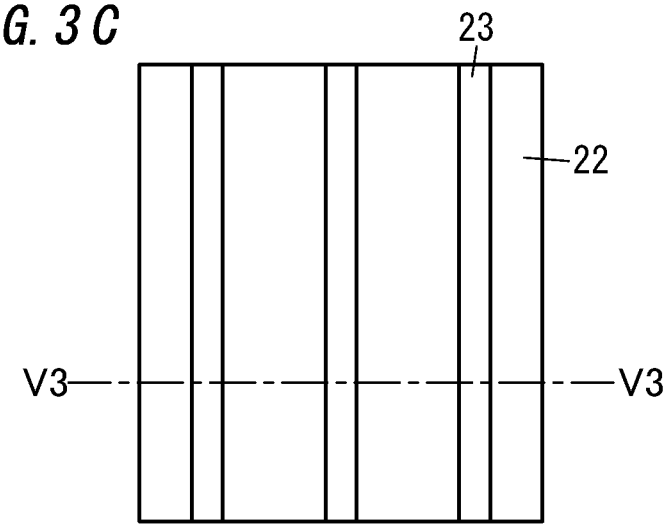
Figure 3D:
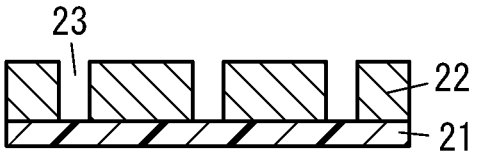

Next, as illustrated in FIGS. 3C and 3D, engraving is performed to form the plurality of grooves 23 in the sheet-like resistive element 22 at regular intervals in a belt-like shape. The grooves 23 penetrate through only the sheet-like resistive element 22 but are not formed in the sheet-like resin substrate 21.

Here, the FIG. 3C is a top view, and the FIG. 3D is a sectional view taken along line V3-V3 in FIG. 3C.

Figure 4A:
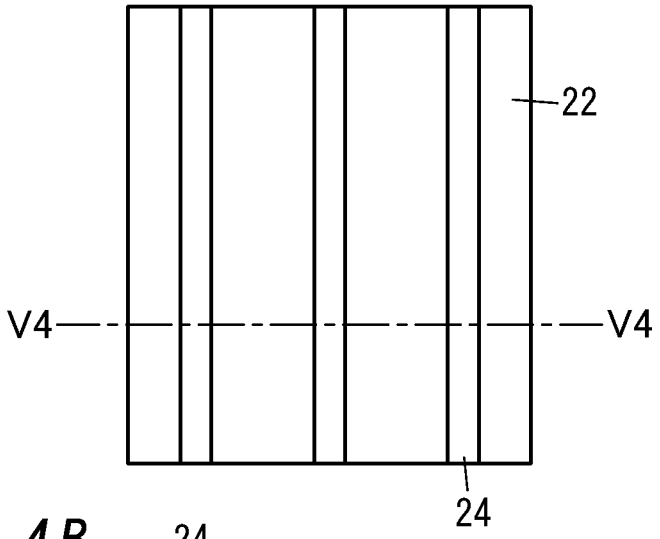
FIGS. 4A to FIG. 4E are views illustrating the manufacturing method of the metal plate resistor.
Figure 4B:
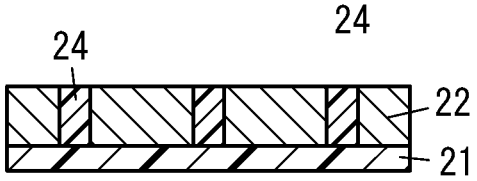

Next, as illustrated in FIGS. 4A and 4B, the grooves 23 are filled with an epoxy resin to form resin layers 24 each having a band-like shape. The resin layers 24 correspond to the third protection film 18 covering the side surfaces of the resistive element 11 and the pair of electrodes 13*a* and 13*b*, the side surfaces being apart from each other in the Y direction.

Here, FIG. 4A is a top view, and FIG. 4B is a sectional view taken along line V4-V4 of FIG. 4A.

Figure 4C:
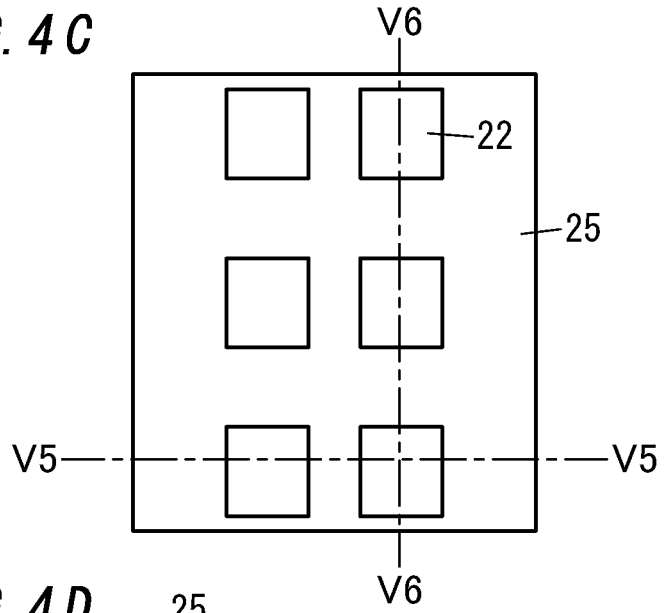
Figure 4D:
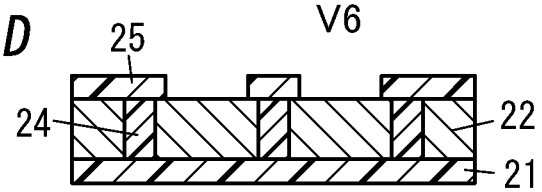
Figure 4E:
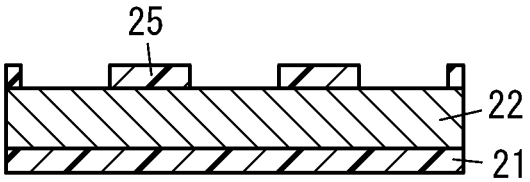

Next, as illustrated in FIGS. 4C, 4D, and 4E, a protection film 25 is formed on the resin layers 24 in the sheet-like resistive element 22 and an upper surface of the sheet-like resistive element 22 around the resin layers 24, and the sheet-like resistive element 22 is exposed at sites where the resin layers 24 is not formed.

At this time, a photolithography method is used such that exposition sites uncovered with the protection film 25 are located at prescribed intervals in a direction parallel to the plurality of grooves 23 (resin layers 24) each having a band-like shape and in a direction orthogonal to the plurality of grooves 23 (resin layers 24) each having a band-like shape.

Moreover, a resist used in the photolithography method is not removed and is used as the protection film 25. The protection film 25 corresponds to the first protection film 14.

Note that the resin layers 24 and the protection film 25 may be concurrently formed. Alternatively, the resist may be removed after the photolithography and another protection film 25 may be formed.

Here, FIG. 4C is a top view, FIG. 4D is a sectional view taken along line V5-V5 of FIG. 4C, FIG. 4E is a sectional view taken along line V6-V6 of FIG. 4C.

Figure 5A:
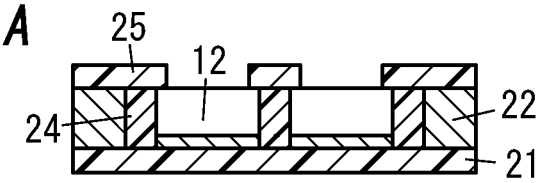
FIGS. 5A to FIG. 5E are views illustrating the manufacturing method of the metal plate resistor.
Figure 5B:
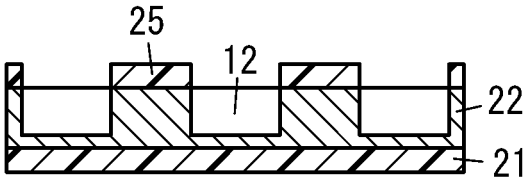

Then, as illustrated in FIGS. 5A and 5B, portions of the sheet-like resistive element 22 which are exposed from the protection film 25 are etched. At this time, not the entirety of the sheet-like resistive element 22 is removed, but a lower part of the sheet-like resistive element 22 is left. Sites, from which the portions of the sheet-like resistive element 22 have been removed by etching, correspond to the recesses 12.

Here, FIG. 5A corresponds to FIG. 4D after etching, and FIG. 5B corresponds to FIG. 4E after etching.

Figure 5C:
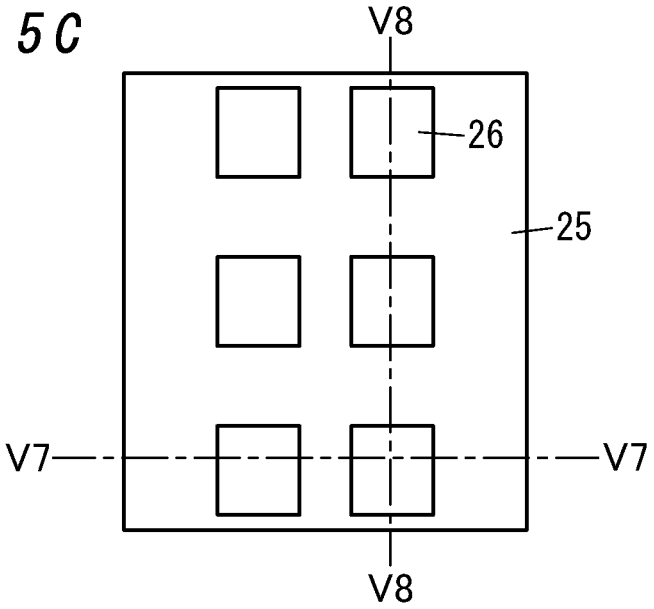
Figure 5D:
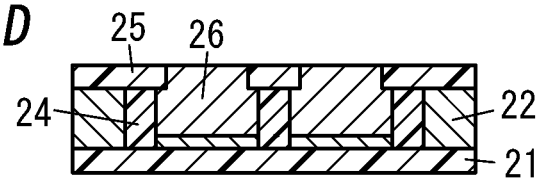
Figure 5E:
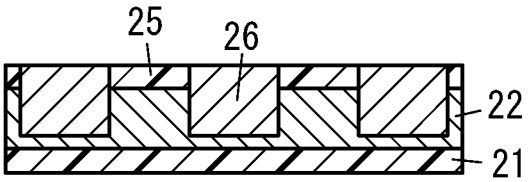

Next, as illustrated in FIGS. 5C, 5D, and 5E, electrode layers 26 are formed by performing plating in the portions (recesses 12) in the sheet-like resistive element 22 removed by etching. The electrode layers 26 are formed to protrude upward beyond the recesses 12 and to extend above the protection film 25. Then, polishing is performed so that upper surfaces of the electrode layers 26 are flush with an upper surface of the protection film 25. The electrode layers 26 correspond to the pair of electrodes 13*a* and 13*b*.

Here, FIG. 5C is a top view, FIG. 5D is a sectional view taken along line V7-V7 of FIG. 5C, FIG. 5E is a sectional view taken along V8-V8 of FIG. 5C.

Figure 6A:
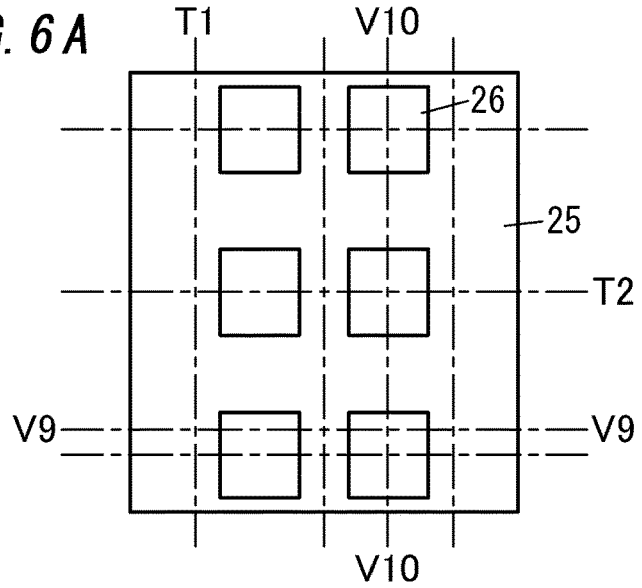
FIGS. 6A to FIG. 6C are views illustrating the manufacturing method of the metal plate resistor.
Figure 6B:
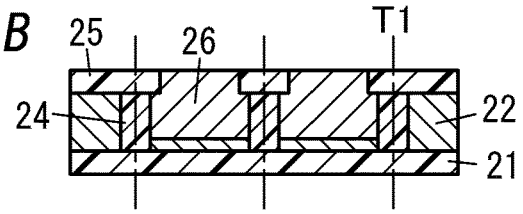
Figure 6C:
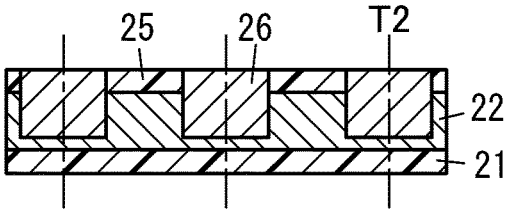

Then, as illustrated in FIGS. 6A, 6B, and 6C, division is performed along lines T1 and along lines T2 to form individual pieces of metal plate resistors 10 of the one embodiment. Each line T1 extends along a center portion of a corresponding one of the resin layers 24 each having a band-like shape. Each line T2 extends through center portions of the electrode layers 26 and is orthogonal to the line T1. In this case, a dividing step along the lines T1 and a dividing step along the lines T2 may be concurrently or sequentially performed. Moreover, when the dividing step along the lines T1 and the dividing step along the lines T2 are sequentially performed, the dividing step along the lines T1 may be performed first, or the dividing step along the lines T2 may be performed first.

Note that for the sake of simple description, FIGS. 3A to 6C show a portion in which the electrode layers 26 are formed in three columns and in two rows in a sheet-like form.

Here, FIG. 6A is a top view, FIG. 6B is a sectional view taken along line V9-V9 of FIG. 6A, FIG. 6C is a sectional view taken along line V10-V10 of FIG. 6A.

As described above, in the metal plate resistor 10 of the one embodiment, the pair of electrodes 13*a* and 13*b* is formed on the end surfaces 11*c* of the resistive element 11, and therefore, a current density in the resistive element 11 in the thickness direction Z is uniform. Thus, a large amount of current uniformly flows between the pair of electrodes 13*a* and 13*b*, and therefore, it is possible to easily reduce the resistance value. Moreover, when temperature rises, the resistance value of the pair of electrodes 13*a* and 13*b* increases, which further increases the amount of current flowing through the end surfaces 11*c* and the upper surface 11*b* of the resistive element 11. This reduces a measured resistance value, which provides the effect that the influence of the pair of electrodes 13*a* and 13*b* over the measured resistance value decreases and the TCR decreases.

Moreover, since each of the second portions 16 formed on the end surfaces 11*c* and included in the pair of electrodes 13*a* and 13*b* has a large width, a larger amount of current flows through the end surfaces 11*c* and the upper surface 11*b* of the resistive element 11, which enables the resistance value to be more easily reduced.

Moreover, each of the pair of electrodes 13*a* and 13*b* is connected to the resistive element 11 at two surfaces, namely, the end surfaces 11*c* of the resistive element 11 and a surface close to the upper surface 11*b* of the resistive element 11. Therefore, the contact area between the pair of electrodes 13*a* and 13*b* and the resistive element 11 is large. This stabilizes connectability, increases strength to stress, and enhances heat dissipation characteristics. Moreover, mounting solder is formed on the lower surface 11*a* and the end surfaces 11*c* of the resistive element 11, accordingly increasing mounting strength.

Since the recesses 12 are formed by etching, locations and sizes of the recesses 12 and the smoothness of inner surfaces of the recesses 12 are stabilized. Thus, it is possible to stably form the pair of electrodes 13*a* and 13*b* to have the prescribed shape. On the inner surfaces of the recesses 12 formed by etching, the pair of electrodes 13*a* and 13*b* is formed by plating but not by printing. Therefore, it is possible to accurately provide the pair of electrodes 13*a* and 13*b*, and the pair of electrodes 13*a* and 13*b* has good adhesiveness to the resistive element 11 and does not require heating. Thus, it is possible to prevent also degradation of the resistive element 11.

Second Configuration Example

Figure 7:
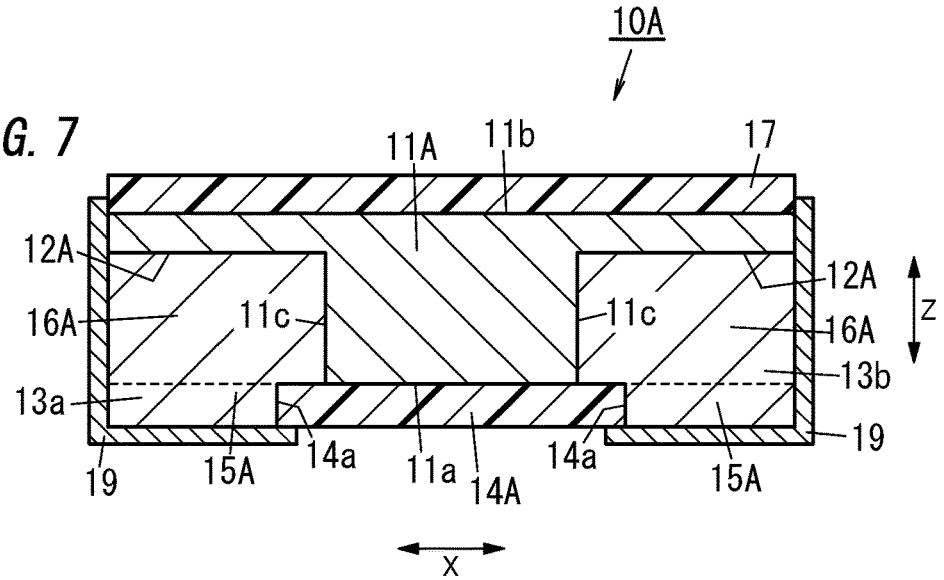
FIG. 7 is a sectional view illustrating a metal plate resistor of another embodiment of the present disclosure.

FIG. 7 is a sectional view illustrating a metal plate resistor 10A of another embodiment of the present disclosure. A second configuration example is different from the first configuration example in that in each of a pair of electrodes 13*a* and 13*b*, the length of a second portion 16A in the length direction X is longer than that of a first portion 15A. Note that the other components are similar to those of the first configuration example, are denoted by the same reference signs, and the description thereof is omitted.

As illustrated in FIG. 7, the metal plate resistor 10A of the present embodiment includes a resistive element 11A, recesses 12A, the pair of electrodes 13*a* and 13*b*, and a first protection film 14A.

Each of the pair of electrodes 13*a* and 13*b* includes the first portion 15A and the second portion 16A. In the present embodiment, in the length direction X of the resistive element 11A, the length of the second portion 16A is longer than the length of the first portion 15A.

As illustrated in FIG. 7, this configuration enables the distance between the second portions 16A of the pair of electrodes 13*a* and 13*b* to be reduced. Thus, a larger amount of current flows through the end surfaces 11*c* of the resistive element 11A, which enables the resistance value to be more easily reduced.

Furthermore, in the thickness direction Z, when the thickness of each of the second portions 16 (depth of each of the recesses 12) of the pair of electrodes 13*a* and 13*b* is 0.5 or more times as large as the thickness of the resistive element 11, a larger amount of current flows through the end surfaces 11*c* and the upper surface 11*b* of the resistive element 11, and therefore, it is possible to reduce the resistance value and the TCR.

Comparative Example

Figure 8:
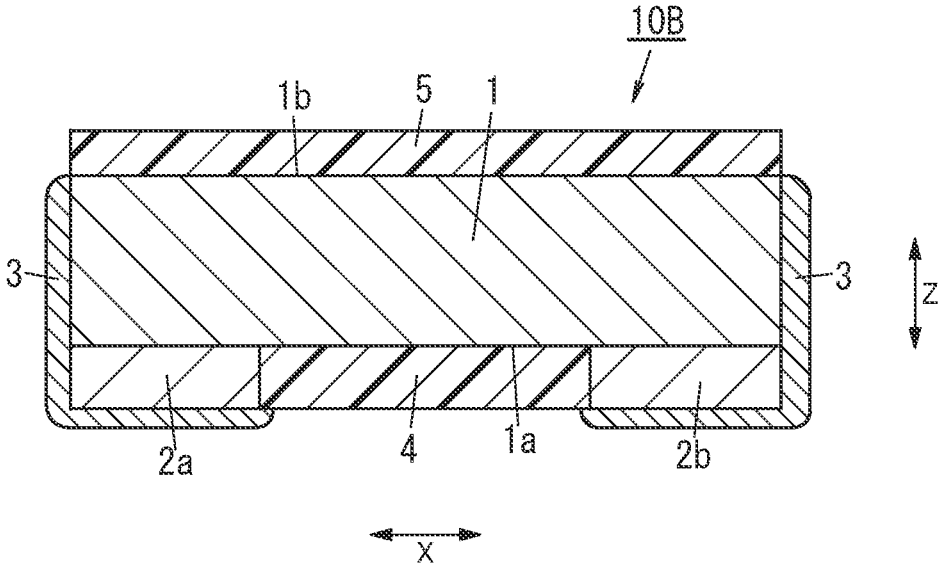
FIG. 8 PRIOR ART
FIG. 8 is a sectional view illustrating a metal plate resistor of a comparative example.

As illustrated in FIG. 8, a metal plate resistor 10B according to a comparative example includes a resistive element 1, a pair of electrodes 2*a* and 2*b*, a plating layer 3, a first protection film 4, and a second protection film 5.

The resistive element 1 includes a metal plate made of CuNi. The pair of electrodes 2*a* and 2*b* is made of Cu. Each of the pair of electrodes 2*a* and 2*b* is provided at opposing ends of a lower surface 1*a* of the resistive element 1. The plating layer 3 is provided to improve soldering properties. The first protection film 4 is formed on a lower surface 1*a* of the resistive element 1 to be located between the pair of electrodes 2*a* and 2*b*. The second protection film 5 is formed on an upper surface 1*b* of the resistive element 1.

Summary

As described above, a metal plate resistor (10A) of a first aspect includes a resistive element (11A), a pair of recesses (12A), a pair of electrodes (13*a*, 13*b*), and a protection film (first protection film 14A). The resistive element (11A) is made of metal. The pair of recesses (12A) is formed at opposing ends of one surface (lower surface 11*a*) of the resistive element (11A). The pair of electrodes (13*a*, 13*b*) has at least portions (second portions 16A) each embedded in a corresponding one of the pair of recesses (12A). The pair of electrodes (13*a*, 13*b*) is made of metal having a lower specific resistance than the resistive element (11A). The protection film is disposed on the one surface of the resistive element (11A) to be located between the pair of electrodes (13*a*, 13*b*). Each of the pair of electrodes (13*a*, 13*b*) includes a first portion (15A) and the second portion (16A). The first portion (15A) protrudes from the one surface of the resistive element (11A) to be in contact with an end of the protection film. The second portion (16A) is disposed in a corresponding recess (12A) of the pair of recesses (12A). In a direction (X direction) in which the pair of electrodes (13*a*, 13*b*) is arranged, the second portion (16A) has a length longer than a length of the first portion (15A).

According to this aspect, it is possible to reduce the resistance value and the TCR. Moreover, this aspect enables the distance between the second portions (16A) of the pair of electrodes (13*a* and 13*b*) to be reduced. Thus, a larger amount of current flows through the end surfaces (11*c*) of the resistive element (11A), which enables the resistance value to be more easily reduced.

In a metal plate resistor (10; 10A) of a second aspect referring to the first aspect, in a direction (Y direction) transverse to a direction in which the pair of electrodes (12; 12A) is arranged, the second portion (16; 16A) has a width larger than a width of the first portion (15; 15A).

According to this aspect, a larger amount of current flows through the end surfaces (11*c*) and the upper surface (11*b*) of the resistive element (11; 11A), which enables the resistance value to be more easily reduced.

In a metal plate resistor (10; 10A) of a third aspect referring to the first or second aspect, in a direction in which the first portion (15; 15A) and the second portion (16; 16A) are arranged, the second portion (16; 16A) has a thickness ½ or more times as large as a thickness of the resistive element (11; 11A).

According to this aspect, a larger amount of current flows through the end surfaces (11*c*) and the upper surface (11*b*) of the resistive element (11; 11A), and therefore, it is possible to reduce the resistance value and the TCR.

A manufacturing method of a fourth aspect is a manufacturing method of a metal plate resistor (10) and includes six steps. A first step is a step of forming a plurality of grooves (23) at regular intervals in a sheet-like resistive element (22) made of metal, each of the plurality of grooves (23) having a band-like shape. A second step is a step of filling the plurality of grooves (23) with a resin to form resin layers (24) each having a band-like shape. A third step is a step of forming a protection film (25) on the sheet-like resistive element (22), the protection film (25) having an opening formed such that the sheet-like resistive element (22) is exposed at sites where the resin layers (24) are not formed so as to have exposed portions. A fourth step is a step of forming a plurality of recesses (12) by etching the exposed portions of the sheet-like resistive element (22), but not through the sheet-like resistive element (22). A fifth step is a step of performing plating in the plurality of recesses (12) to form a plurality of electrode layers (26). A sixth step is a step of performing cutting along a centerline (T1) of each of the resin layers (24) each having a band-like shape and performing cutting along a line (T2) extending through centers of the plurality of electrode layers (26) to divide the sheet-like resistive element (22) into individual pieces, the line being transverse to the centerline (T1).

According to this aspect, it is possible to reduce the resistance value and the TCR.

The configurations of the second and third aspects are not essential configurations for the metal plate resistor (10; 10A) and may accordingly be omitted.

INDUSTRIAL APPLICABILITY

A metal plate resistor according to the present disclosure has the effect of enabling a resistance value and a TCR to be reduced and is useful as, for example, a metal plate resistor used in applications for detecting a current of an information communication device represented by a smartphone or a tablet computer.

REFERENCE SIGNS LIST

10, 10A METAL PLATE RESISTOR
11, 11A RESISTIVE ELEMENT
11A LOWER SURFACE (ONE SURFACE)
12, 12A RECESS
13A, 13B PAIR OF ELECTRODES
14, 14A FIRST PROTECTION FILM
15, 15A FIRST PORTION OF PAIR OF ELECTRODE

16, 16A SECOND PORTION OF PAIR OF ELECTRODE
22 SHEET-LIKE RESISTIVE ELEMENT
23 GROOVE
24 RESIN LAYER
25 PROTECTION FILM
26 ELECTRODE LAYER
T1 CENTERLINE
T2 LINE

The invention claimed is:

1. A metal plate resistor, comprising:

a resistive element made of metal;

a pair of recesses formed at opposing ends of one surface of the resistive element;

a pair of electrodes having at least portions each embedded in a corresponding one of the pair of recesses, the pair of electrodes being made of metal having a lower specific resistance than the resistive element; and a protection film disposed on the one surface of the resistive element to be located between the pair of electrodes, wherein each of the pair of electrodes includes a first portion protruding from the one surface of the resistive element to be in contact with an end of the protection film and a second portion disposed in a corresponding recess of the pair of recesses, and in a direction in which the pair of electrodes is arranged, the second portion has a length longer than a length of the first portion.

2. The metal plate resistor of claim 1, wherein in a direction transverse to a direction in which the pair of electrodes is arranged, the second portion has a width larger than a width of the first portion.

3. The metal plate resistor of claim 2, wherein in a direction in which the first portion and the second portion are arranged, the second portion has a thickness ½ or more times as large as a thickness of the resistive element.

4. The metal plate resistor of claim 1, wherein in a direction in which the first portion and the second portion are arranged, the second portion has a thickness ½ or more times as large as a thickness of the resistive element.

5. A manufacturing method of a metal plate resistor, the manufacturing method comprising:

a step of forming a plurality of grooves at regular intervals in a sheet-like resistive element made of metal, each of the plurality of grooves having a band-like shape;

a step of filling the plurality of grooves with a resin to form resin layers each having a band-like shape;

a step of forming a protection film on the sheet-like resistive element, the protection film having an opening formed such that the sheet-like resistive element is exposed at sites where the resin layers are not formed so as to have exposed portions;

a step of forming a plurality of recesses by etching the exposed portions of the sheet-like resistive element, but not through the sheet-like resistive element;

a step of performing plating in the plurality of recesses to form a plurality of electrode layers; and a step of performing cutting along a centerline of each of the resin layers each having a band-like shape and performing cutting along a line extending through centers of the plurality of electrode layers to divide the sheet-like resistive element into individual pieces, the line being transverse to the centerline.

* * * * *